US006654582B2

(12) United States Patent
Jones et al.

(10) Patent No.: US 6,654,582 B2
(45) Date of Patent: Nov. 25, 2003

(54) MAGNETIC ROLL ASSEMBLY

(75) Inventors: Robert T. Jones, Rochester, NY (US); Edmund T. Varga, Webster, NY (US); Thomas Thomson, Fairport, NY (US); Robert M. Foti, Bloomfield, NY (US); Martin L. Keymel, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 6 days.

(21) Appl. No.: 10/029,648

(22) Filed: Dec. 31, 2001

(65) Prior Publication Data

US 2003/0123908 A1 Jul. 3, 2003

(51) Int. Cl.[7] ..... G03G 15/09
(52) U.S. Cl. ..... 399/277; 492/8
(58) Field of Search ..... 399/265, 277, 399/279, 280; 335/296, 302, 303, 306; 492/8, 38, 45; 29/895.21

(56) References Cited

U.S. PATENT DOCUMENTS 4,558,294 A * 12/1985 Yamashita ..... 335/303
4,580,121 A 4/1986 Ogawa ..... 335/303
4,823,102 A * 4/1989 Cherian et al. ..... 335/306
5,019,796 A 5/1991 Lee et al. ..... 335/302
5,030,937 A * 7/1991 Loubier et al. ..... 335/303
5,758,242 A * 5/1998 Malespin et al. ..... 399/277
6,125,255 A * 9/2000 Litman et al. ..... 399/277

FOREIGN PATENT DOCUMENTS

DE 219 099 2/1910

* cited by examiner

*Primary Examiner*—Hoan Tran
(74) *Attorney, Agent, or Firm*—Tallam I. Nguti

(57) ABSTRACT

A magnetic roll assembly including an roll core made of a first material and having a longitudinal axis; plural locating members formed of the first material on the outside surface for locating strip magnets; and plural strip magnets located on the plural locating members on the outside surface, the plural strip magnets each having at least first and second surfaces, and a mating feature on one of the at least first and second surfaces mirroring one of the plural locating members for locating and attaching each the plural strip magnets to the roll core, thereby resulting in a magnetic roll assembly that is easily and correctly assembled, and that facilitates rework and remanufacturing.

16 Claims, 4 Drawing Sheets

MAGNETIC ROLL ASSEMBLY

BACKGROUND OF THE INVENTION

This invention relates generally to electrostatographic reproduction machines, and more particularly concerns a magnetic roll assembly for use in a development station of such a machine.

In the process of electrostatographic printing, a photoconductive member is uniformly charged and exposed to a light image of an original document. Exposure of the photoconductive member records an electrostatic latent image corresponding to the informational areas contained within the original document. After the electrostatic latent image is recorded on the photoconductive surface, the latent image is developed by bringing a developer material into contact therewith. Generally, the developer material comprises toner particles adhering triboelectrically to carrier granules. The toner particles are attracted from the carrier granules to form a toner powder image on the photoconductive member which corresponds to the informational areas contained within the original document. This toner powder image is subsequently transferred to a copy sheet and permanently affixed thereto in image configuration.

In electrostatographic reproduction machines, magnetic rolls are frequently employed in the developing station and the cleaning station. Typically, the magnetic roll includes a core and strips of magnets adhesively glued or bonded to the core. At the developing station, a developer material of magnetic carrier granules having toner particles adhering triboelectrically thereto is attracted to the surface of the magnetic roll by the magnetic field generated by the magnetic roll.

The developer material attracted as such is advanced by the surface of the magnetic roll to a position closely adjacent the electrostatic latent image recorded on the photoconductive member. The latent image attracts the toner particles, thus forming a toner powder image on the photoconductive member.

When a magnetic roll is used at the cleaning station, a layer of carrier granules is adhered to the surface of the magnetic roll and is moved therewith. As the layer of carrier granules passes closely adjacent to the photoconductive member, residual toner particles on the photoconductive member are attracted to the layer of carrier granules and are then moved therewith away from the photoconductive member. In this way, residual toner particles are cleaned from the photoconductive member.

Particularly at the development station, proper location of magnets on the magnet roll core is essential to the proper functioning of the development station. This is because incorrect polarity magnets being placed on the core will compromise xerographic performance of the development station.

The conventional use of glue or adhesive bonds to adhere the magnets to the core of the magnetic roll is however a significant problem. Such use of glue does not facilitate rework or remanufacture of the magnet roll assembly without causing damage to the individual magnets or the magnet roll core. Adhering magnets as such onto a magnet roll core is a very time consuming activity and does not encompass any type of foolproofing in terms of the actual location where the magnets are placed onto the magnet roll core.

Typically, placement of each magnet onto the magnet roll core is currently a responsibility of an operator.

Consequently, an operator has to reference the part number that is inscribed on each magnet and then cross reference the assembly print to determine where that particular magnet is to be placed on the magnet roll core. This can be problematic when different magnets to be attached or adhered have the same cross sectional geometry and polarity is the only defining difference between magnets. It is therefore very likely that magnets can be glued in the incorrect location if an operator is being rushed to produce parts.

There is therefore a need for a magnetic roll assembly that is easily and correctly assembled, and that can facilitate rework and remanufacturing.

SUMMARY OF THE INVENTION

In according to the present invention, there is provided a magnetic roll assembly including an roll core made of a first material and having a longitudinal axis; plural locating members formed of the first material on the outside surface for locating strip magnets; and plural strip magnets located on the plural locating members on the outside surface, the plural strip magnets each having at least first and second surfaces, and a mating feature on one of the at least first and second surfaces mirroring one of the plural locating members for locating and attaching each the plural strip magnets to the roll core, thereby resulting in a magnetic roll assembly that is easily and correctly assembled, and that facilitates rework and remanufacturing.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
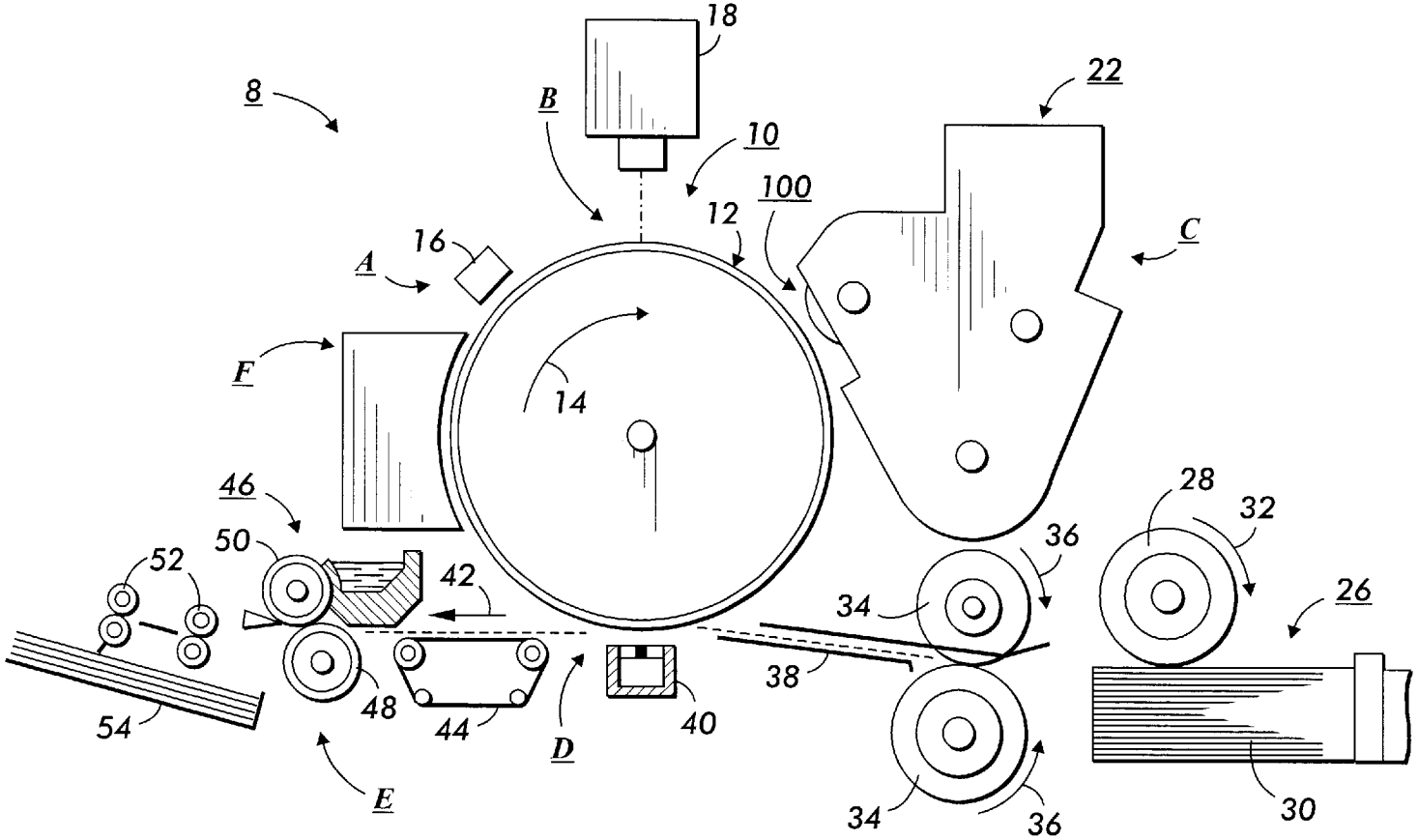
FIG. 1 is a schematic elevational view showing an illustrative electrostatographic reproduction machine incorporating the magnetic roll assembly of the present invention therein.

Referring first to FIG. 1, an exemplary electrostatographic reproduction machine 8 is illustrated incorporating various components, including the magnetic roll assembly 100 of the present invention. It will become evident from the following discussion that this magnetic roll assembly 100 is equally well suited for use in a wide variety of electrostatographic reproduction machines and is not necessarily limited in its application to the particular embodiment or method of manufacture described herein.

Inasmuch as the art of electrostatographic printing is well known, the various processing stations employed in the FIG. 1 reproduction machine will be shown hereinafter only schematically, and their operation described only briefly with reference thereto. As shown in FIG. 1, the illustrative electrostatographic reproduction machine 8 employs a drum 10 having a photoconductive surface 12 adhering to a conductive substrate. Preferably, photoconductive surface 12 comprises a selenium alloy with the conductive substrate being an electrically grounded aluminum alloy. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential.

Next, the charged portion of photoconductive surface 12 is advanced through imaging station B. Imaging station B includes an exposure system, indicated generally by the reference numeral 18. Exposure system 18 includes lamps which illuminate an original document positioned face down upon a transparent platen. The light rays reflected from the original document are transmitted through a lens to form a light image thereof. The light image is focused onto the charged portion of photoconductive surface 12 to selectively dissipate the charge thereon. This records an electrostatic latent image on photoconductive surface 12 which corresponds to the information in the original document. Drum 10 advances the electrostatic latent image recorded on photoconductive surface 12 to development station C.

At development station C, a developer unit, indicated generally by the reference numeral 22, has a magnetic roll assembly, indicated generally by the reference numeral 100, which transports a developer mixture of carrier granules having toner particles adhering triboelectrically thereto into contact with the electrostatic latent image. Toner particles are attracted from the carrier granules to the latent image forming a toner powder image. The detailed structure of magnetic roll assembly 100 will be described hereinafter with reference to FIGS. 2 through 4, inclusive.

After development of the electrostatic latent image, drum 10 advances the toner powder image to transfer station D. At transfer station D, a copy substrate such as a sheet of support material is moved into contact with the toner powder image. The sheet of support material is advanced to transfer station D by a sheet feeding apparatus, indicated generally by the reference numeral 26. Preferably, sheet feeding apparatus 26 includes a feed roll 28 contacting the uppermost sheet of a stack of sheets 30. Feed roll 28 rotates in the direction of arrow 32 to advance the uppermost sheet into a nip defined by forwarding rollers 34. Forwarding rollers 34 rotate in the direction of arrow 36 to advance the sheet into chute 38. Chute 38 directs the advancing sheet into contact with photoconductive surface 12 in a timed sequence so that the toner powder image developed thereon contacts the advancing sheet at transfer station D.

Transfer station D includes a corona generating device 40 which sprays ions onto the backside of the sheet. This attracts the toner powder image from photoconductive surface 12 to the sheet. After transfer, the sheet continues to move in the direction of arrow 42 on conveyor 44 to advance to fusing station E.

Fusing station E includes a fuser assembly, indicated generally by the reference numeral 46, which permanently affixes the transferred toner powder image to the sheet. Preferably, fuser assembly 46 includes a back-up roll and a heated fuser roller 50. The sheet passes between fuser roller 50 and back-up roll with the powder image contacting fuser roller 50. In this manner, the toner powder image is permanently affixed to the sheet. After fusing, forwarding rollers 52 advance the sheet to catch tray 54 for subsequent removal from the reproduction machine by the operator.

After the powder image is transferred from photoconductive surface 12 to the copy sheet, drum 10 rotates the photoconductive surface to cleaning station F. At cleaning station F, a cleaning system, employing a magnetic roll assembly 100, for example, substantially identical to the magnetic roll assembly 100 of the developer unit 22, removes the residual particles adhering to photoconductive surface 12. The magnetic roll assembly 100 transports carrier granules closely adjacent to the photoconductive surface to attract residual toner particles thereto. In this way, the residual toner particles are removed from photoconductive surface 12.

It is believed that the foregoing description is sufficient for purposes of the present invention to illustrate the general operation of an electrostatographic reproduction machine incorporating the features of the present invention therein.

Figure 2:
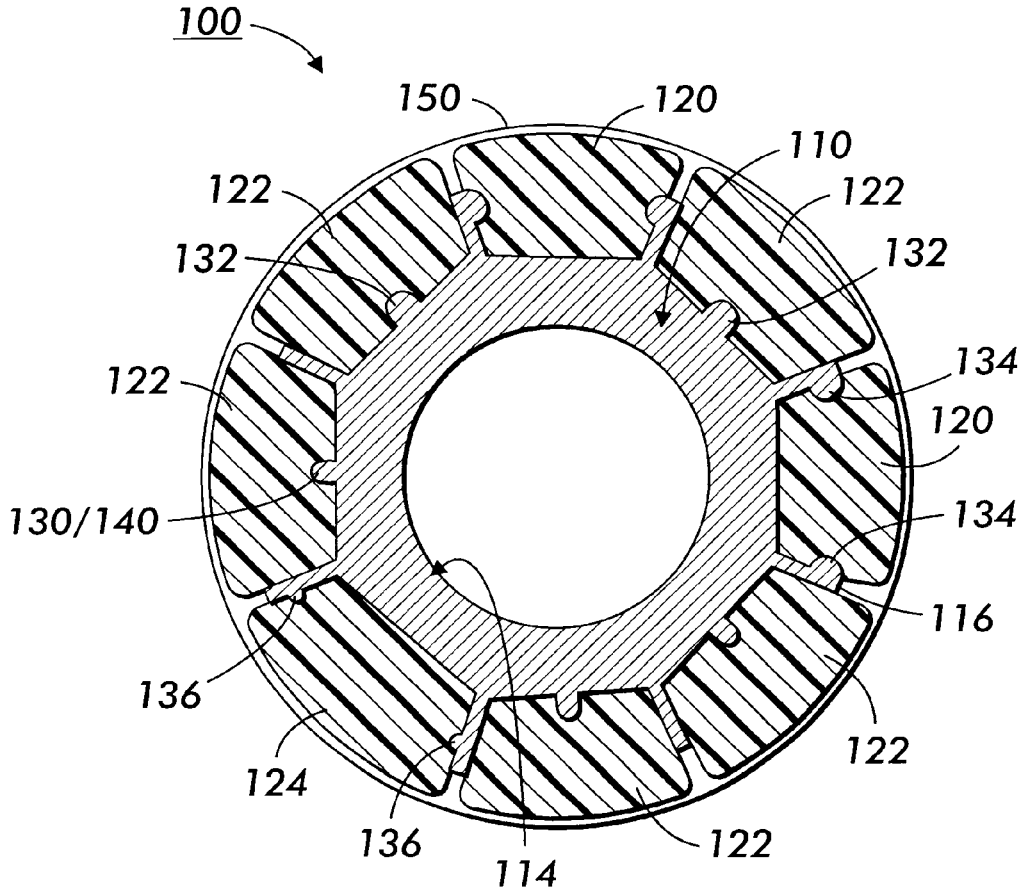
FIG. 2 is an cross-sectional illustration of the magnetic roll assembly of the present invention.
Figure 3:
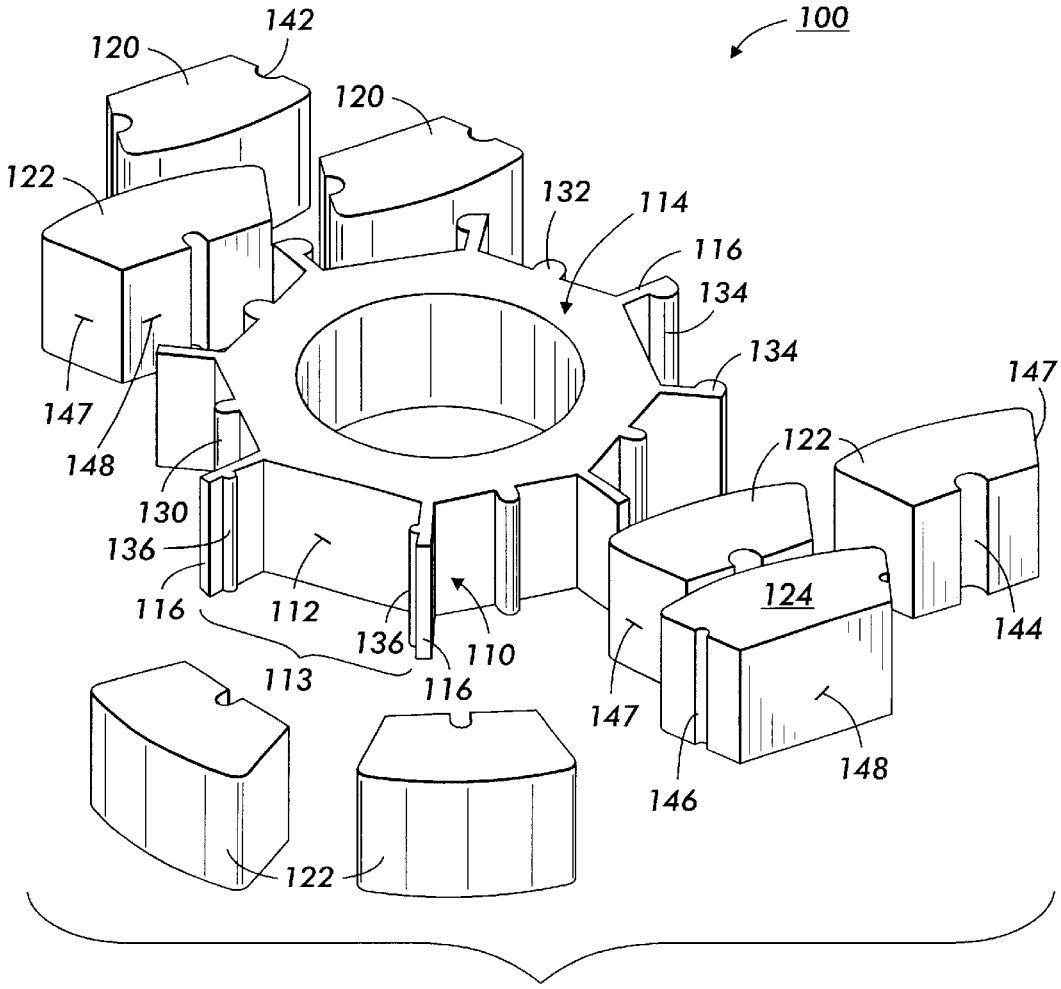
FIG. 3 is a perspective view collectively of the roll core and strip magnets of the magnetic roll assembly of the present invention.
Figure 4:
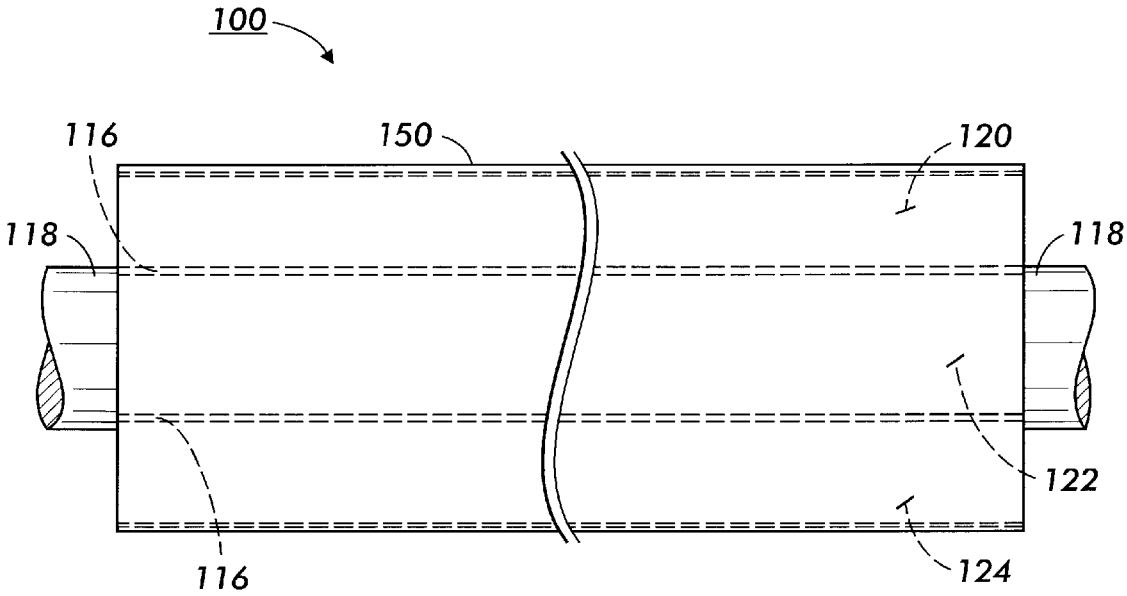
FIG. 4 is a side view of the magnetic roll assembly of the present invention.

Referring now to the specific subject matter of the present invention, FIGS. 2 through 4, inclusive, depict the magnetic roll assembly 100 in greater detail. As shown, magnetic roll assembly 100 includes a core 110 that may be extruded, and a series of extruded strip magnets 120, 122, 124 forming its exterior and extending in a longitudinal direction substantially parallel to the longitudinal axis of core 110. A plurality of substantially equally spaced fins 116 extend generally outwardly from a cylindrical portion 114 of the core 110. The fins 116 are formed integrally with the core 110 and define spaces 113 between them. A shaft 118 extends outwardly from opposed ends of the core along the longitudinal axis thereof. Shaft 118 may also be formed integrally with the core 110 with one portion thereof extending outwardly from one end of cylindrical portion 114 of the core 110 and the other portion thereof extending outwardly from the other end.

A first series of differently shaped mating geometric members as illustrated in FIG. 2, for example male mating members, indicated generally by the reference numeral 130, are formed, for example by extrusion, onto the surface 112 of the core 110, and on the fins 116 for matingly mounting and adhering the extruded strip magnets 120, 122, 124 onto the core. As shown particularly in FIG. 3, male mating geometric members 132 are differently shaped and are formed on the surface 112 of the cylindrical portion 114, and male mating geometric members 134 and 136 which are also differently shaped, for example are formed on the fins 116. The fins 116, the spaces 113, and hence the strip magnets 120, 122, 124 are spaced circumferentially cylindrical portion 114.

In accordance with the present invention, instead of attaching the strip magnets with glue or adhesive, the extruded strip magnets 120, 122, 124 each have mating features, shown generally as 140, that mirror those on the core 110. As such, each strip magnet (FIG. 3) has formed therein at least one female mating feature 142, 144, 146 that mirrors, and can mate with a corresponding male mating feature 130 on the magnetic roll core 110 as described above. The male and female mating features 130, 140 are formed so as to provide a slight interference fit and for an easy snap-in fit or slide-in fit. As such, the strip magnets 120, 122, 124 can be secured one to a mating feature or features 130 within each space 113 between adjacent fins 116. For example, where there are six fins 116 defining six spaces 113, there will be six extruded strip magnets 120, 122, 124 secured to mating features. During assembly, a magnetic field may be generated to hold the extruded strip magnets 120, 122, 124 in a selected position, and with a particular orientation with respect to one another for obtaining a predetermined magnetic field. Hall probes for example can be used for detecting the intensity of the magnetic field being generated by the extruded strip magnets 120, 122, 124 as assembled. The strip magnets 120, 122, 124 are held in this orientation by the magnetic fields and by the interference fit between the mating features 130 and 140, and there allowed to cure.

Referring again to FIG. 1, during operation of the machine 8, magnetic roll assembly 100 rotates to advance the developer material into contact with photoconductive surface 12 of drum 10. By way of example, magnetic roll assembly 100 is made preferably from an extruded aluminum tube or core 110 having the fins 116 and mating features 132, 134, 136 formed thereon. The fins 116, and shaft 118 are integral with one another. Extruded strip magnets 120, 122, 124 are made from magnetic ferrite/PVC (polyvinyl chloride) material.

The present invention allows the placement of the strip magnets 120, 122, 124 onto the magnet roll core 110 to be restricted to locations where the core design mates with the geometry extruded into the strip magnet. This is important because proper location of the magnets onto the magnet roll core 110 is essential to the proper functioning of the development station, for example. Incorrect polarity magnets placed onto the core will compromise xerographic performance of the development station. In accordance with the present invention, the absence of glue or adhesive in the assembly 100 facilitates rework and remanufacture of the magnet roll assembly 100 and prevents damage to the individual strip magnets or the magnet roll core 110.

The geometric mating members 130 (132, 134, 136), 140 are differently shaped as clearly shown in FIG. 2, and so provide locational positioning, adherence and foolproofing for the placement of the strip magnets 120, 122, 124 onto the magnet roll core 110. Two geometric shapes can be used to accomplish this. Longitudinally extending radial grooves, recesses or keyways 142, 144, 146 which serve as female mating features 140 can be extruded into the side walls 147 or into the bottom flat surface 148 of each strip magnet 120, 122, 124 for mating with mirroring mating features 132, 134, 136 on the magnet roll core 110. On the magnet roll core 110, longitudinally extending radial lobes or lugs 132, 134, 136 which serve as male mating features 130 and mirror the female features 140, can be formed so as to provide for either a snap fit or slide-on insertion between the strip magnets and the magnet roll core 110.

As further shown, in order to additionally adhere or constrict the strip magnets 120, 122, 124 onto the roll core 110, plastic shrink-wrap 150 may be applied over the entire surface of the assembled core and strip magnets, and then heat treated to a shrink fit. As pointed out above, the magnets 120, 12, 124 will adhere to magnet roll core 110 via a slight interference fit between the mating features, the magnet side walls, and the magnet roll core fins 116. Once all of the strip magnets are assembled onto the magnet roll core 110, the plastic shrink-wrap 150 is then applied over the assembly and activated by heat to constrict the wrap diameter. This further promotes adherence of the magnets to the core.

As can be seen, there has been provided a magnetic roll assembly including an roll core made of a first material and having a longitudinal axis; plural locating members formed of the first material on the outside surface for locating strip magnets; and plural strip magnets located on the plural locating members on the outside surface, the plural strip magnets each having at least first and second surfaces, and a mating feature on one of the at least first and second surfaces mirroring one of the plural locating members for locating and attaching each the plural strip magnets to the roll core, thereby resulting in a magnetic roll assembly that is easily and correctly assembled, and that facilitates rework and remanufacturing.

What is claimed is:

1. A magnetic roll assembly comprising:

(a) a roll core made of a first material and having an outside surface and a longitudinal axis;

(b) plural differently shaped locating members formed of said first material on said outside surface for locating and positioning strip magnets in selected positions and particular orientation; and (c) plural strip magnets located on said plural differently shaped locating members on said outside surface, said plural strip magnets each having at least first and second surfaces, and a mating feature on at least one of said at least first and second surfaces mirroring one of said plural differently shaped locating members for locating and attaching of each said plural strip magnets to said roll core, thereby enabling accurately locating and adhering the strip magnets to the roll core in selected positions and particular orientation without use of adhesives.

2. The magnetic roll assembly of claim 1, wherein said plural differently shaped locating members are spaced circumferentially about said roll core.

3. The magnetic roll assembly of claim 1, wherein said plural differently shaped locating members extend from a first end towards a second end of said roll core.

4. A magnetic roll assembly comprising:

(a) a roll core having a longitudinal axis and an external surface;

(b) differently shaped first mating geometric members formed on said external surface; and (c) strip magnets each having at least one second and mirroring mating geometric member for insertion and mating with one of said differently shaped first mating geometric members on said external surface of said roll core, said differently shaped first mating geometric members and said second mirroring mating geometric members enabling easy and correct assembly of a magnetic roll that facilitates rework and remanufacturing.

5. The magnetic roll assembly of claim 4, wherein said roll core includes fin members projecting radially from said external surface.

6. The magnetic roll assembly of claim 5, wherein said fin members are spaced circumferentially about said external surface.

7. The magnetic roll assembly of claim 5, wherein said fin members define spaces between adjacent fin members for receiving inserted strip magnets.

8. The magnetic roll assembly of claim 5, wherein some of said differently shaped first mating geometric members on said roll core are formed on at least some of said fin members.

9. The magnetic roll assembly of claim 4, wherein each of said strip magnets has a bottom surface contoured to follow said external surface of said roll core, and said at least one mirroring mating geometric member is formed on said bottom surface.

10. The magnetic roll assembly of claim 4, wherein each of said strip magnets has radially extending side walls and said at least one mirroring mating geometric member is formed on one of said radially extending side walls.

11. The magnetic roll assembly of claim 4, including a non-magnetic thin film applied over said strip magnets assembled on said roll core.

12. The magnetic roll assembly of claim 4, wherein said roll core is made of aluminum.

13. The magnetic roll assembly of claim 4, wherein said strip magnets are made of a ferrite/polyvinyl chloride material.

14. The strip magnets of claim 4, wherein said differently shaped first mating geometric members comprise male mating geometric members projecting from said external surface.

15. An electrostatographic reproduction machine comprising:

(a) a moveable image bearing member having an image bearing surface;

(b) imaging means for forming a developable latent image on said image bearing surface of said image bearing member;

(c) a development apparatus containing developer material having toner for developing said developable latent image into a toner image;

(d) transfer means for transferring said toner image onto a copy substrate;

(e) a cleaning apparatus for receiving residual toner from said image bearing surface; and (f) a magnetic roll assembly including:

(i) a roll core made of a first material and having an outside surface and a longitudinal axis;

(ii) plural differently shaped locating members formed of said first material on said outside surface for locating and positioning strip magnets in selected positions and particular orientation; and (iii) plural strip magnets located on said plural differently shaped locating members on said outside surface, said plural strip magnets each having at least first and second surfaces, and a mating feature on at least one of said at least first and second surfaces mirroring one of said plural differently shaped locating members for locating and attaching each of said plural strip magnets to said roll core, thereby enabling accurately locating and adhering the strip magnets to the roll core in selected positions and particular orientation without use of adhesives.

16. The electrostatographic reproduction machine of claim 15, wherein said magnetic roll assembly is mounted for operation in said development apparatus.

* * * * *